US009962042B2

(12) United States Patent
Hierath et al.

(10) Patent No.: US 9,962,042 B2
(45) Date of Patent: May 8, 2018

(54) ARTICLE SUPPORT

(71) Applicants: Leonard L. Hierath, Denver, CO (US); Melissa Ruth Harris, Denver, CO (US)

(72) Inventors: Leonard L. Hierath, Denver, CO (US); Melissa Ruth Harris, Denver, CO (US)

( * ) Notice: Subject to any disclaimer, the term of this patent is extended or adjusted under 35 U.S.C. 154(b) by 0 days. days.

(21) Appl. No.: 14/945,418

(22) Filed: Nov. 18, 2015

(65) Prior Publication Data

US 2016/0143488 A1 May 26, 2016

Related U.S. Application Data

(60) Provisional application No. 62/082,142, filed on Nov. 20, 2014.

(51) Int. Cl.

| | |
|---|---|
| ***A47K 5/02*** | (2006.01) |
| *A47K 5/03* | (2006.01) |
| *A47K 5/04* | (2006.01) |

(52) U.S. Cl.

CPC ..... *A47K 5/02* (2013.01); *A47K 5/03* (2013.01); *A47K 5/04* (2013.01)

(58) Field of Classification Search

CPC ... A47K 5/03; A47K 5/04; A47K 5/00; A47K 5/02

USPC ..... 248/176.1, 684, 346.11, 346.03; D6/540, D6/536; 441/136; 312/351; 206/77.1; 211/85.12

See application file for complete search history.

(56) References Cited

U.S. PATENT DOCUMENTS

| | | | | |
|---|---|---|---|---|
| 349,890 A | | 9/1886 | Laxton | |
| 1,353,103 A | * | 9/1920 | Welcker | A47K 5/02 248/222.51 |
| 1,404,730 A | * | 1/1922 | Bandy | A47K 5/03 312/351 |
| 1,479,361 A | | 1/1924 | Blevens | |
| 1,660,729 A | * | 2/1928 | Strock | A47K 5/03 15/244.4 |
| 1,683,566 A | * | 9/1928 | Mix | A47K 5/02 137/560 |

(Continued)

FOREIGN PATENT DOCUMENTS

| | | | | |
|---|---|---|---|---|
| CH | 504199 A | * | 3/1971 | A47K 5/03 |
| DE | 19934524 C2 | * | 5/2002 | A47K 5/04 |

(Continued)

*Primary Examiner* — Kimberly T Wood

(74) *Attorney, Agent, or Firm* — Roger A. Jackson

(57) ABSTRACT

An article support for a surface, the support including a base having a first end portion and a second end portion, the base first end portion is adjacent to the surface. A reservoir is disposed within the second end portion, the reservoir having a terminating margin periphery forming an aperture. An omni-directional substantially planar extension originating at the margin periphery and outwardly terminating in an outer perimeter, the planar extension has a segmented primary surface and a secondary surface wherein the secondary surface faces the first end portion. A portion of the primary surface is formed from an inverted equilateral square pyramid wherein an apex of the pyramid is disposed within the aperture. Operationally, the article is placed upon the primary surface, the article having a plurality of point contacts upon the primary surface causing the article to clear the margin periphery for drainage from the article into the reservoir.

4 Claims, 12 Drawing Sheets

(56) References Cited

U.S. PATENT DOCUMENTS

| | | | | | |
|---|---|---|---|---|---|
| 1,859,492 | A | * | 5/1932 | Balestra | A47K 5/03 248/346.11 |
| 2,026,288 | A | | 12/1935 | Swift | |
| 2,319,104 | A | * | 5/1943 | Andrews | A47K 5/03 312/351 |
| 2,722,719 | A | * | 11/1955 | Altstadter | B26D 3/006 206/523 |
| 2,781,651 | A | * | 2/1957 | Cutler | A47G 19/2283 131/240.1 |
| 2,932,119 | A | * | 4/1960 | Borah | A47K 5/02 248/346.11 |
| 3,343,774 | A | * | 9/1967 | Pryor | A47K 5/03 211/126.1 |
| 3,910,661 | A | | 10/1975 | Geary | |
| D252,841 | S | * | 9/1979 | Koh | D6/536 |
| D252,845 | S | * | 9/1979 | Gavin | D7/400 |
| 4,277,042 | A | | 7/1981 | Ash, Sr. | |
| D261,202 | S | * | 10/1981 | Shames | D6/536 |
| D266,807 | S | * | 11/1982 | Thompson | D6/540 |
| D285,396 | S | * | 9/1986 | Odate | D6/536 |
| D337,465 | S | * | 7/1993 | Paulin | D6/540 |
| 5,253,752 | A | * | 10/1993 | Jang | A47K 5/02 206/77.1 |
| D386,026 | S | * | 11/1997 | von Buelow | D6/540 |
| D446,980 | S | * | 8/2001 | Lillelund | D6/536 |
| D532,634 | S | * | 11/2006 | Nagoya | D6/536 |
| D549,503 | S | * | 8/2007 | Nagoya | D6/536 |
| 9,138,108 | B2 | * | 9/2015 | Pixley | A47K 5/02 |
| 2008/0302927 | A1 | * | 12/2008 | Tredinnick | A47K 5/03 248/176.1 |
| 2013/0043360 | A1 | * | 2/2013 | Pixley | A47K 5/02 248/231.91 |

FOREIGN PATENT DOCUMENTS

| | | | | | |
|---|---|---|---|---|---|
| FR | 582693 | A | * | 12/1924 | A47K 5/03 |
| GB | 190704933 | A | * | 12/1907 | |
| GB | 190704933 | A | * | 12/1907 | |
| GB | 191103359 | A | * | 6/1911 | A47K 5/03 |
| GB | 191103359 | A | * | 6/1911 | |
| GB | 247373 | A | * | 2/1926 | A47K 5/03 |
| GB | 635527 | A | * | 4/1950 | A47K 5/03 |
| GB | 716661 | A | * | 10/1954 | A47K 5/03 |
| GB | 1330111 | A | * | 9/1973 | A47K 5/02 |
| JP | 3182564 | U | * | 4/2013 | |
| KR | 101238515 | B1 | * | 2/2013 | |

* cited by examiner

ARTICLE SUPPORT

RELATED PATENT APPLICATION

This application claims the benefit of U.S. provisional patent application Ser. No. 62/082,142 filed on Nov. 20, 2014 by Leonard L. Hierath, et al., of Denver, Colo., U.S.

TECHNICAL FIELD

The present invention relates generally to article supports. More particularly, the present invention of the article support is a pedestal support for placement upon a surface, wherein the article support is designed to support the article on four points on a peripheral portion allowing for an open space as between the article and the support for drainage and elevation of the article away from the drainage thus keeping the deleterious effects of the drainage away from the article.

BACKGROUND OF INVENTION

As is well known the deterioration or wasting away of an article in the form of a bar of soap in a soap holder is a common occurrence due to the soap resting in a partial reservoir of residual water (being drainage from the soap or environmental water spray) that causes a portion of the bar of soap to become very soft, pasty, and to waste or erode away easily at the bar of soap's next use. Thus, not only does the soap bar need to be initially elevated above the residual water to help prevent partial wasting away of the soap bar, there needs to be an accommodation for the reduction in soap bar size such that as the bar of soap reduces in size due to usage it still retains a four point peripheral support elevated above the residual water to continue to prevent wasting away of the bar of soap via residual water. Another challenge is that there is no standardization of soap bar shapes, some are round, some are oval, some are arcuate in shape, some are rectangular, and some are square, basically resulting in a number of derivations from a basic parallelepiped shape, i.e. such as in IVORY soap bars being square edged and rectangular in shape. Another issue is in the residual water that needs to be contained in a reservoir so as not to run all over the countertop, shelf, or whatever surface that the support for the soap is placed on.

In the prior art, most bar of soap holders are of a dish type shape having a relatively flat support surface with some sort of drainage channels within the support surface for residual water removal, wherein a typical problem is that the drainage channels clog up with soap paste (as the channels tend to be quite small) thus significantly reducing the ability of the residual water to drain, causing the portion of the soap bar to be immersed in the residual water that facilitates the wasting of a portion of the bar of soap.

In looking at the prior art in this area, in U.S. Pat. No. 3,910,661 to Geary, disclosed is a soap holder that has a "V" shaped one-way inclined soap bar support surface, with a gate type edge to keep the soap bar from sliding down the incline. However, in Geary the residual water merely runs off of the incline surface onto the surface that the soap holder is placed upon (having no reservoir), thus only making the Geary soap holder suitable for the side of a bathtub, such that the residual water runoff drains back into the bathtub itself.

Next, in the prior art in U.S. Pat. No. 1,479,361 to Blevens, disclosed is a soap dish that has a flat support surface with multiple shallow drainage channels within the support surface for residual water removal wherein the channels drain to a central channel that drains to a reservoir on one side of the soap dish. In Blevens, the weight of the bar of soap will cause it to literally melt into the shallow channels causing the channels to plug up with soft pasty soap material thus resulting in the lower portion of the soap bar to waste away from being submerged in the residual water.

Further, in the prior art in U.S. Pat. No. 2,319,104 to Andrews disclosed is a soap holder that being somewhat similar to Blevens wherein Andrews has narrow transverse support beams 14 that are positioned flat as against the bottom of the soap bar that are perpendicular to a somewhat larger main residual water drain channel, however, the beams 14 having a small support area on the bottom of the bar of soap that would tend to "cut" into the soap bar due to the weight of the soap bar and the soft nature of the soap bar material, as being an effect of the narrow beams 14 supporting the bar of soap, see FIGS. 1 to 4.

Continuing, in the prior art in U.S. Pat. No. 4,277,042 to Ash, Sr., disclosed is a bar soap receptacle that is essentially like Andrews, with Ash having the narrow beam support, however, being on a steep incline with one end of the narrow beams having a perpendicular extension to hold the bar of soap in place, thus having the same problems as Andrews with the narrow beams cutting into the soft soap bar material allowing the bar of soap to rest directly on the flat surface, thus facilitating the bottom of the soap bar being wet with residual water causing soap bar material to waste away. Further, for the residual water drainage like Geary, Ash has the residual water draining into the bathtub directly (having no reservoir), thus only making the Ash soap holder suitable for the side of a bathtub, such that the residual water runoff drains back into the bathtub itself.

Further, in the prior art in U.S. Pat. No. 2,026,288 to Swift disclosed is a soap dish that has a slightly inclined flat surface with several narrow protruding ridges to slightly elevate the bar of soap for drainage as between the ridges, however, the ridges could easily cut into the bar of soap that is soft and pasty thus allowing the bottom of the bar of soap to rest on the flat surface and again meaning that the bottom of the soap bar is trapped in residual water on the flat surface thus causing more wasting away of the soap bar, being similar to Ash and Andrews for having small area soap bar support which tends to allow the soft pasty soap material to sink downward into the residual water.

Further, in the prior art in U.S. Pat. No. 349,890 to Laxton, disclosed is a soap dish that is similar to Swift in that Laxton has a series of narrow ridges that support the bar of soap wherein the ridges are to slightly elevate the bar of soap for drainage as between the ridges, however, the ridges could easily cut into the bar of soap that is soft and pasty thus allowing the bottom of the bar of soap to rest directly on the drain opening, effectively plugging the drain openings again meaning that the bottom of the soap bar is trapped in residual water thus causing more wasting away of the soap bar. Further, Laxton only drains the residual water onto the surface that the soap dish is placed on like Geary, thus only making the Laxton soap holder suitable for the side of a bathtub, such that the residual water runoff drains back into the bathtub itself (i.e. Laxton having no residual water reservoir).

What is needed is a single piece soap bar support which supports the soap on a portion of the soap bar outer periphery consistently utilizing a larger surface area of support as against the bar of soap, further reducing the effect of the bar of soap "sinking" due to a small surface area of support that embeds into the soft soap material from the residual water dampened soap material, as from a typical soap bar holder.

Also, as the bar of soap reduces in size with use, keeping the bar of soap elevated over the residual water as the bar of soap reduces in size, thus keeping the residual water drainage away from the soap bar freely flowing whether the bar of soap is large or small. Further a reservoir would be needed to hold the residual water such that the countertop, shelf, or other surface is isolated from the residual water that drains from the bar of soap.

SUMMARY OF INVENTION

Broadly, the present invention is for an article support for placement upon a surface, the article support including a base having a lengthwise axis, the base having a first end portion and an opposing second end portion with the lengthwise axis spanning therebetween, the base first end portion being positioned adjacent to the surface. Further included in the article support is a reservoir disposed within the base second end portion, the reservoir having a terminating margin periphery forming a reservoir aperture portion. In addition, included in the article support is an omni-directional substantially planar extension originating at the margin periphery and outwardly terminating in an outer perimeter, the planar extension being substantially perpendicular to the lengthwise axis. Further, the planar extension has a segmented primary surface and an opposing secondary surface, wherein the secondary surface faces the base first end portion in position. The primary surface forming an inverted equilateral square pyramid wherein an apex of the pyramid is disposed within the aperture and each side face of the pyramid forms a proximal portion of a segment of the planar extension primary surface thus resulting in forming an angled plane wherein a distal portion of each segment planar extension primary surface extends beyond the proximal portion in the angled plane with the distal portion terminating at the outer perimeter.

Wherein operationally, the article is placed upon the primary surface, with the article having a plurality of point contacts upon the primary surface resulting in the article being separated from the terminating margin periphery to facilitate unimpeded drainage from the article into the reservoir.

These and other objects of the present invention will become more readily appreciated and understood from a consideration of the following detailed description of the exemplary embodiments of the present invention when taken together with the accompanying drawings, in which;

REFERENCE NUMBERS IN DRAWINGS

Figure 1:
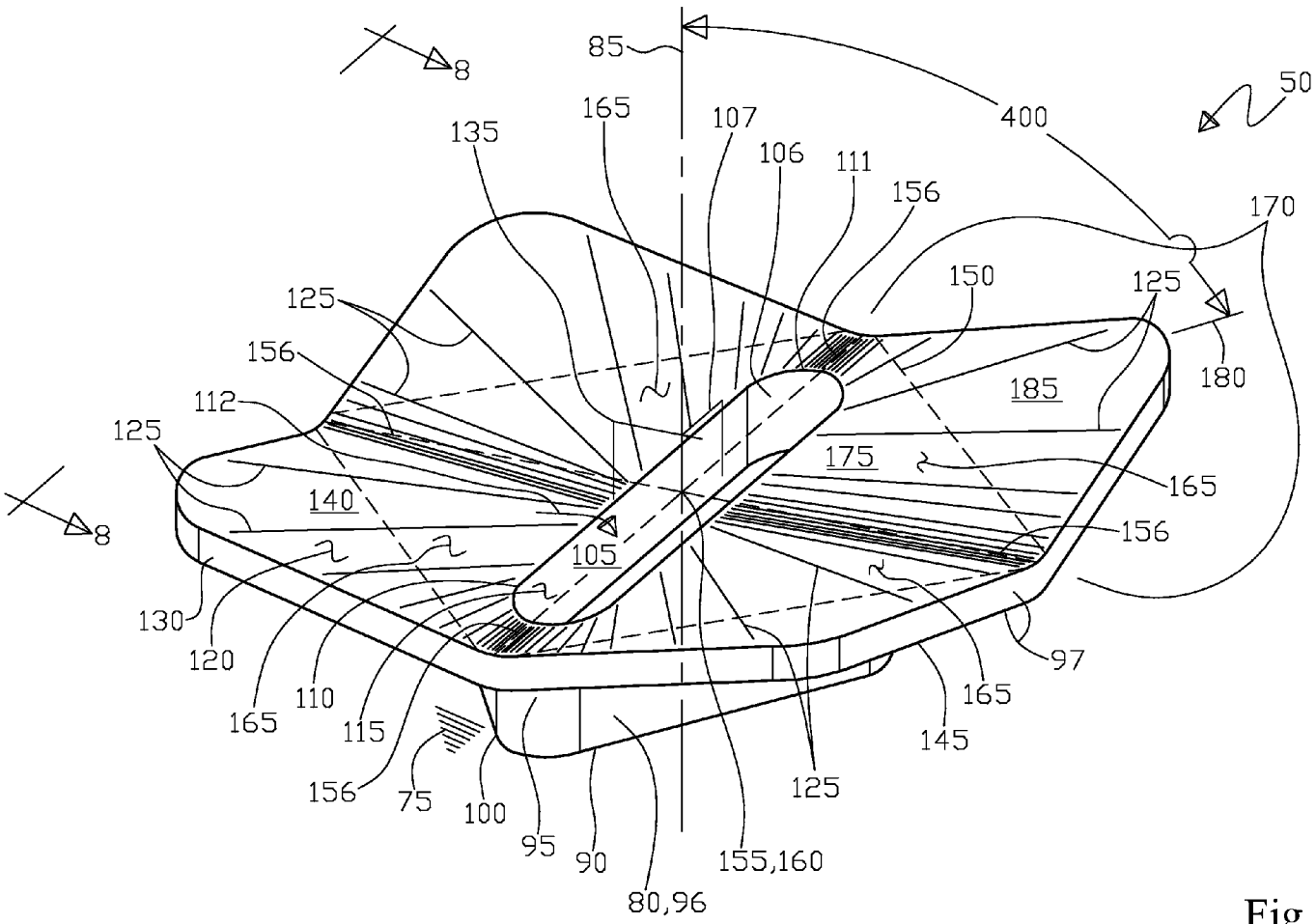
FIG. 1 shows an elevated perspective view of the article support that includes a surface, a base, a lengthwise axis of the base, a first end portion of the base, a second end portion of the base, an adjacent position of the first end portion to a surface, a reservoir, a terminating margin of the reservoir, an aperture of the reservoir, a substantially planar extension, a substantially perpendicular position of the planar extension to the lengthwise axis, the segmented primary surface, a secondary surface, an inverted equilateral square pyramid (dashed lines), an apex of the pyramid (dashed lines), disposing of the apex within the aperture (dashed lines), a side face of the pyramid (dashed lines), a segment of the planar extension primary surface, a proximal portion of the segment, an angled plane of the proximal portion, a distal portion of the segment, and an outer perimeter of the planar extension.

50 Article support
55 Article in the form of a bar of soap
60 Plurality of point contacts of the article 55
65 Separation of the article 55 from the terminating margin 110
70 Drainage from the article 55 into the reservoir 105
75 Surface
80 Base
85 Lengthwise axis of the base 80
90 First end portion of the base 80
95 Second end portion of the base 80
96 Outer terminating skirt of the base 80
97 Flange on planar extension 120 and outer perimeter 130
100 Adjacent position of the surface 75 for the first end portion 90 of the base 80
101 Manual grasping of the flange 97
105 Reservoir
106 Elongated open channel shape of the reservoir 105
107 Perpendicular extension of the reservoir 105 to the lengthwise axis 85
110 Terminating margin periphery of the reservoir 105
111 Transitional radius of the terminating margin periphery 110
112 Continuously smooth drainage 70 flow path
115 Aperture of the reservoir 105
120 Substantially planar extension
125 Omni-directional nature of the substantially planar extension 120
130 Outer perimeter of the substantially planar extension 120
135 Substantially perpendicular position of the substantially planar extension 120 to the lengthwise axis 85
140 Segmented primary surface of the substantially planar extension 120
145 Secondary surface of the substantially planar extension 120
150 Inverted equilateral square pyramid
155 Apex of the inverted equilateral square pyramid 150
156 Furrow
160 Apex disposed within the aperture 115
165 Side face of the pyramid 150
170 Segment of the substantially planar extension 120 primary surface 140
175 Proximal portion of the segment 170 formed by the side face 165
180 Angled plane of the proximal portion 175
185 Distal portion of the segment 170
200 First alternative embodiment of the article 55 support
205 Planar primary surface of the substantially planar extension 120
210 Angled plane of the planar primary surface 205
215 Trough disposed in the planar primary surface 205
300 Second alternative embodiment of the article 55 support
305 Arcuate primary surface of the substantially planar extension 120
310 Angled plane of the arcuate primary surface 305
400 Acute angle of the angled plane 180, 210, 310 to the lengthwise axis 85
405 Arc of the planar extension 120
410 Constant radius of the arc 405
415 Fixed origin point
420 Juxtapose position of the arc 405 to the elongated open channel shape 106
425 Ellipse
430 Major axis of the ellipse 425
435 Minor axis of the ellipse 425
440 Fixed radius of the ellipse 425
445 Pivot point of the fixed radius 440
450 Travelling of the pivot point 445 along the minor axis 435
455 Symmetrical distance of pivot point 445 travelling along 450 the minor axis 435
460 Juxtapose position of the ellipse 425 to the elongated channel shape 106

DETAILED DESCRIPTION

With initial reference to FIG. 1, shown is an elevated perspective view of the article support 50 that includes a surface 75, a base 80, a lengthwise axis 85 of the base 80, a first end portion 90 of the base 80, a second end portion 95 of the base 80, and an adjacent position 100 of the first end portion 90 to the surface 75. Also shown in FIG. 1, is a reservoir 105, a terminating margin 110 of the reservoir 105, an aperture 115 of the reservoir 105, a substantially planar extension 120, a substantially perpendicular position 135 of the planar extension 120 to the lengthwise axis 85, a segmented primary surface 140, and a secondary surface 145. Further, the segmented primary surface 140 shaped as an inverted equilateral square pyramid 150 (dashed lines), an apex 155 of the pyramid 150 (dashed lines), disposing 160 of the apex 155 within the aperture 115 (dashed lines), and a side face 165 of the pyramid 150 (dashed lines). In addition, FIG. 1 shows a segment 170 of the planar extension 120 primary surface 140, a proximal portion 175 of the segment 170, an angled plane 180 of the proximal portion 175, a distal portion 185 of the segment 170, and an outer perimeter 130 of the planar extension 120.

Figure 2:
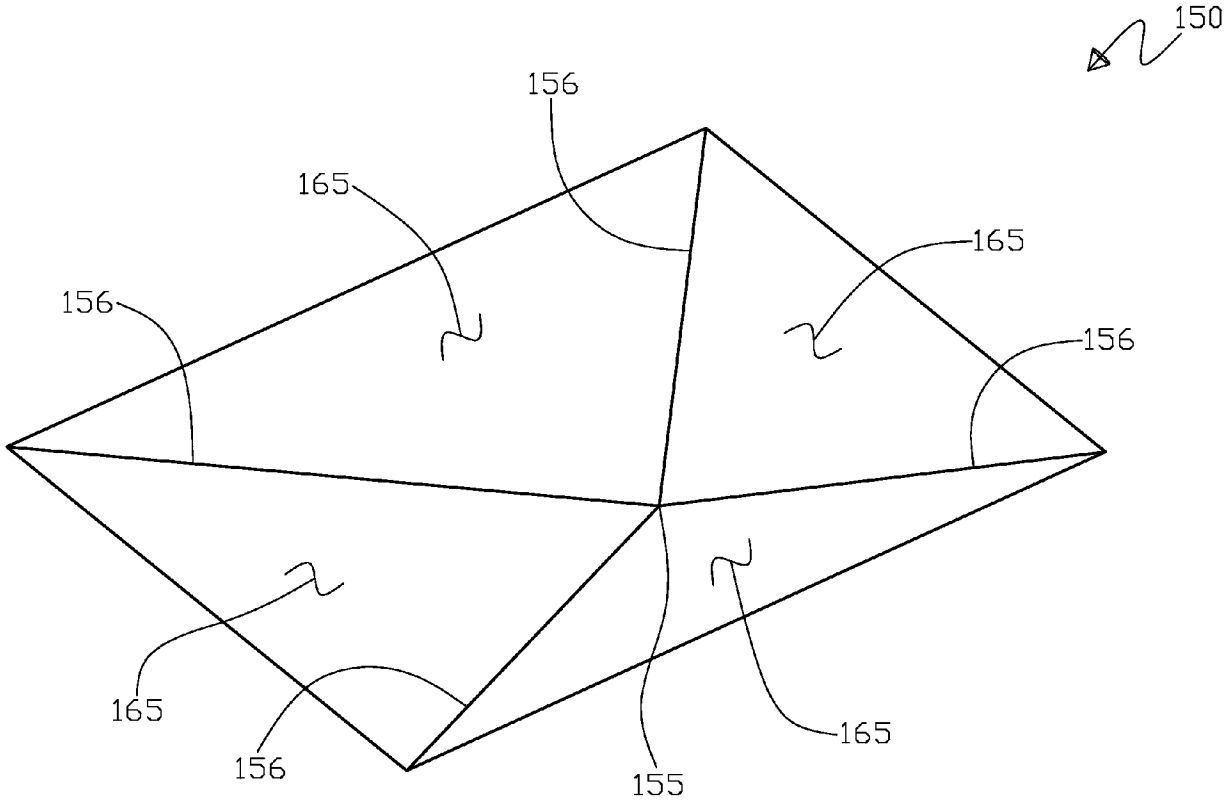
FIG. 2 shows the elevated perspective view of FIG. 1, however, only including the inverted equilateral square pyramid, the apex of the pyramid, and the side face of the pyramid, with the base, reservoir, and substantially planar extension removed for clarity to show the pyramid alone as it is placed within, and forms the proximal portions of the primary surface of the planar extension as shown in FIG. 1.

Continuing, FIG. 2 shows the elevated perspective view of FIG. 1, however, only including the inverted equilateral square pyramid 150, the apex 155 of the pyramid 150, and the side face 165 of the pyramid 150, with the base 80, the reservoir 105, and the substantially planar extension 120 removed for clarity to show the pyramid 150 alone as it is placed within and forms the proximal portions 175 of the primary surface 140 of the planar extension 120 as shown in FIG. 1.

Figure 3:
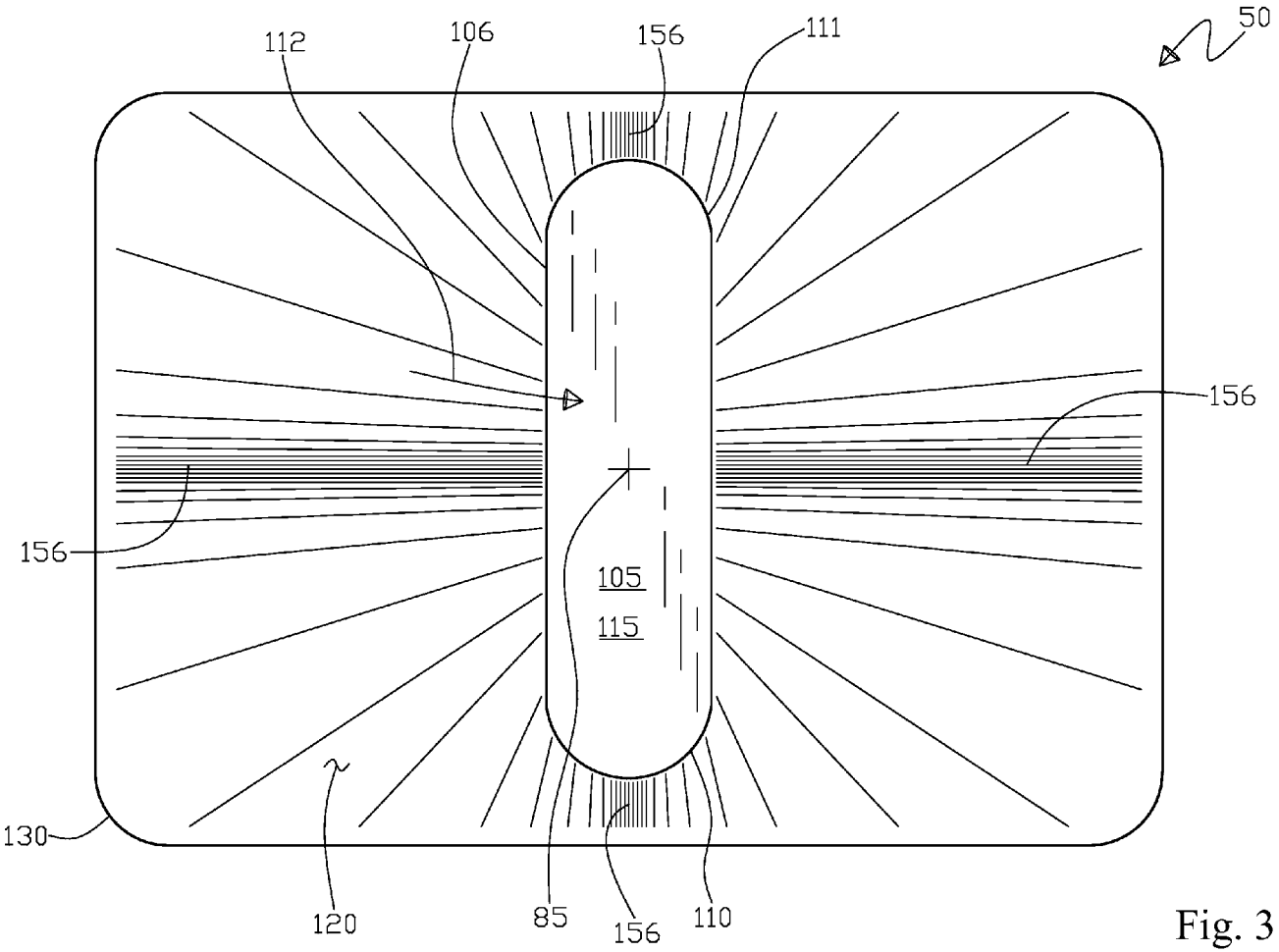
FIG. 3 shows an overhead view of the article support that includes the lengthwise axis or the base, the reservoir, the terminating margin of the reservoir, the aperture of the reservoir, the substantially planar extension, and the outer perimeter of the planar extension.

Next, FIG. 3 shows an overhead view of the article support 50 that includes the lengthwise axis 85 of the base 80, the reservoir 105, the terminating margin 110 of the reservoir 105, the aperture 115 of the reservoir 105, the substantially planar extension 120, and the outer perimeter 130 of the planar extension 120.

Figure 4:
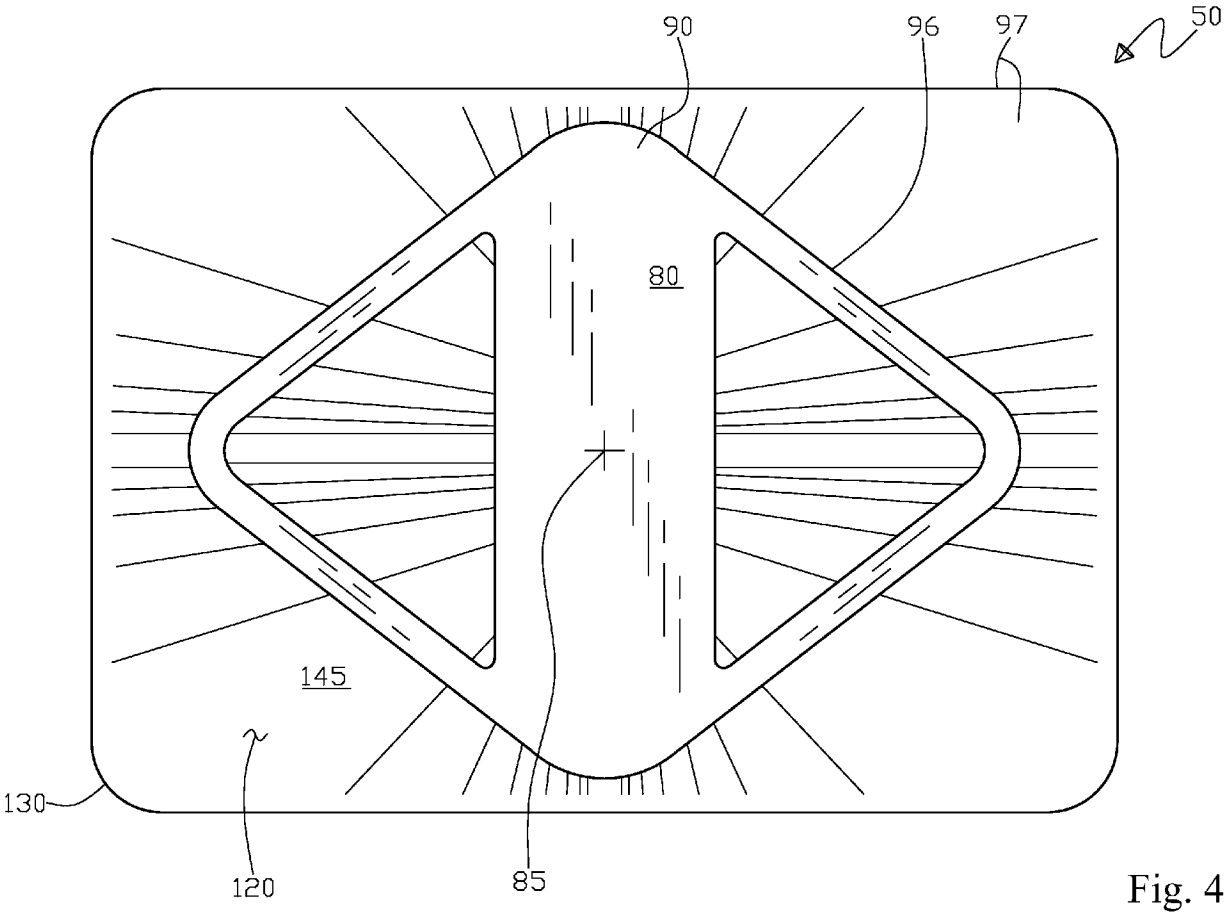
FIG. 4 shows a surface side view of the article support that includes the base, the lengthwise axis of the base, the first end portion of the base, the substantially planar extension, the secondary surface, and the outer perimeter of the planar extension.

Moving onward, FIG. 4 shows a surface 75 side view of the article support 50 that includes the base 80, the lengthwise axis 85 of the base 80, the first end portion 90 of the base 80, the substantially planar extension 120, the secondary surface 145, and the outer perimeter 130 of the planar extension 120.

Figure 5:
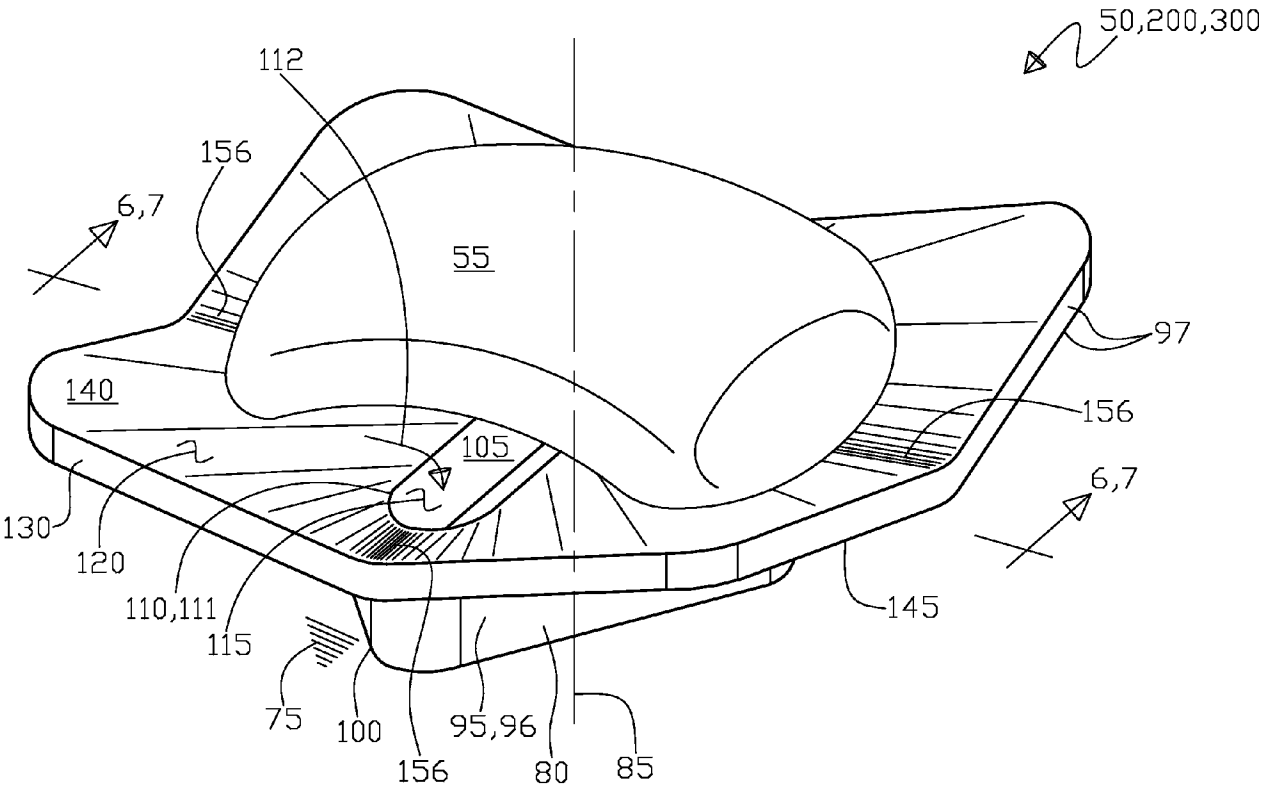
FIG. 5 shows an elevated perspective view of the article support of FIG. 1, however, being in use with an article positioned upon the primary surface, that includes the surface, the base, the lengthwise axis of the base, the first end portion of the base, the second end portion of the base, the adjacent position of the first end portion to the surface, the reservoir, the terminating margin of the reservoir, the aperture of the reservoir, the substantially planar extension, the secondary surface, and the outer perimeter of the planar extension.

Further, FIG. 5 shows an elevated perspective view of the article support 50 of FIG. 1, however, being in use with an article 55 positioned upon the primary surface 140, that includes the surface 75, the base 80, and the lengthwise axis 85 of the base 80. FIG. 5 also shows the first end portion 90 of the base 80, the second end portion 95 of the base 80, the adjacent position 100 of the first end portion 90 to the surface 75, the reservoir 105, the terminating margin 110 of the reservoir 105, the aperture 115 of the reservoir 105, the substantially planar extension 120, the secondary surface 145, and the outer perimeter 130 of the planar extension 120.

Figure 6:
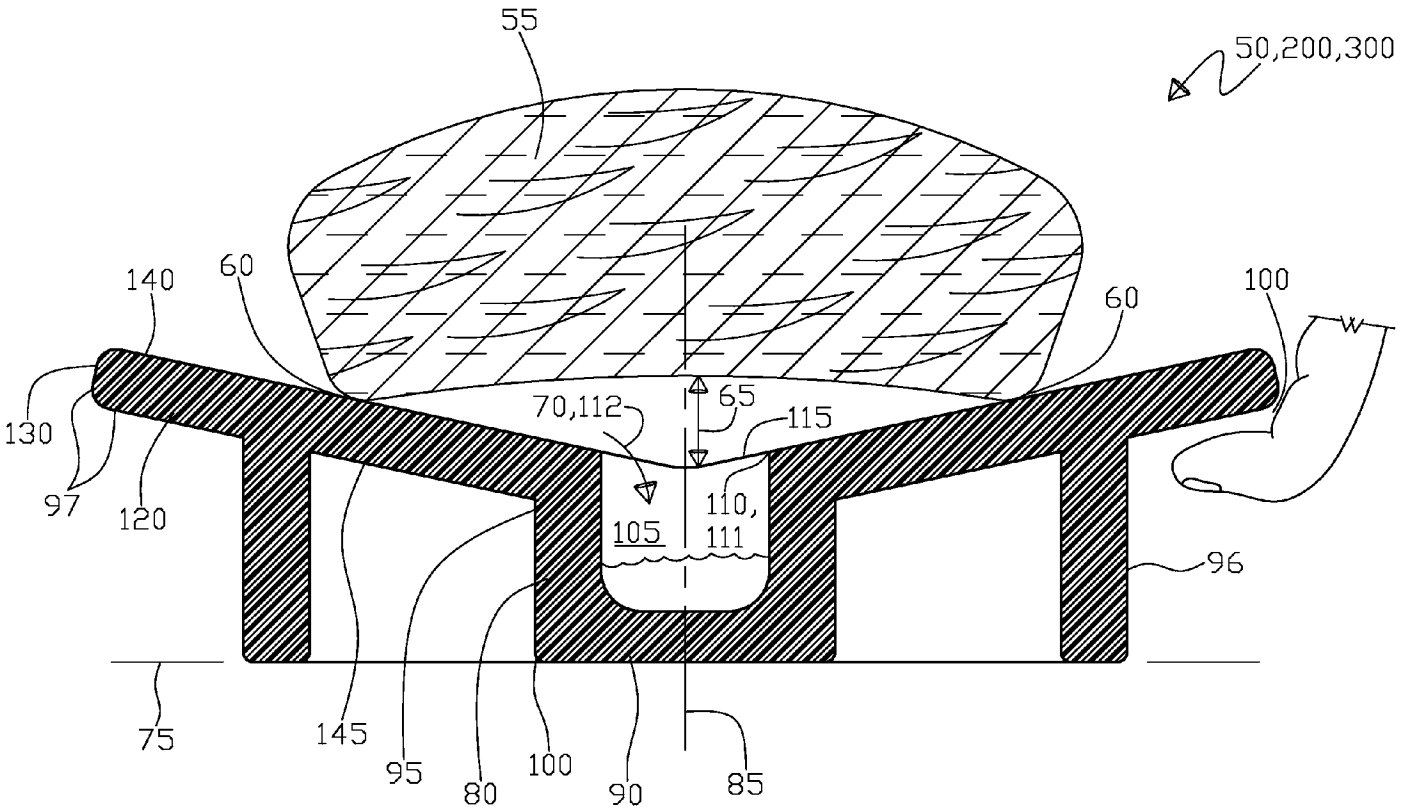
FIG. 6 shows cross section 6-6 of FIG. 5, the article support being in use with the article positioned upon the primary surface, showing a plurality of contact points of the article on the primary surface, a separation of the article from the terminating margin, a drainage from the article into the reservoir, with the elevated perspective view of the article support that includes the surface, the base, the lengthwise axis of the base, the first end portion of the base, the second end portion of the base, the adjacent position of the first end portion to the surface, the reservoir, the terminating margin of the reservoir, the aperture of the reservoir, the substantially planar extension, the segmented primary surface, the secondary surface, and the outer perimeter of the planar extension.

Yet further, FIG. 6 shows cross section 6-6 of FIG. 5, the article 55 support 50 being in use with the article 55 positioned upon the primary surface 140, showing a plurality of contact points 60 of the article 55 on the primary surface 140, a separation 65 of the article 55 from the terminating margin 110, and a drainage 70 from the article 55 into the reservoir 105. FIG. 6 also shows the elevated perspective view of the article 55 support 50 that includes the surface 75, the base 80, the lengthwise axis 85 of the base 80, the first end portion 90 of the base 80, and the second end portion 95 of the base 80. FIG. 6 also shows the adjacent position 100 of the first end portion 90 to the surface 75, the reservoir 105, the terminating margin 110 of the reservoir 105, the aperture 115 of the reservoir 105, the substantially planar extension 120, the segmented primary surface 140, the secondary surface 145, and the outer perimeter 130 of the planar extension 120.

Figure 7:
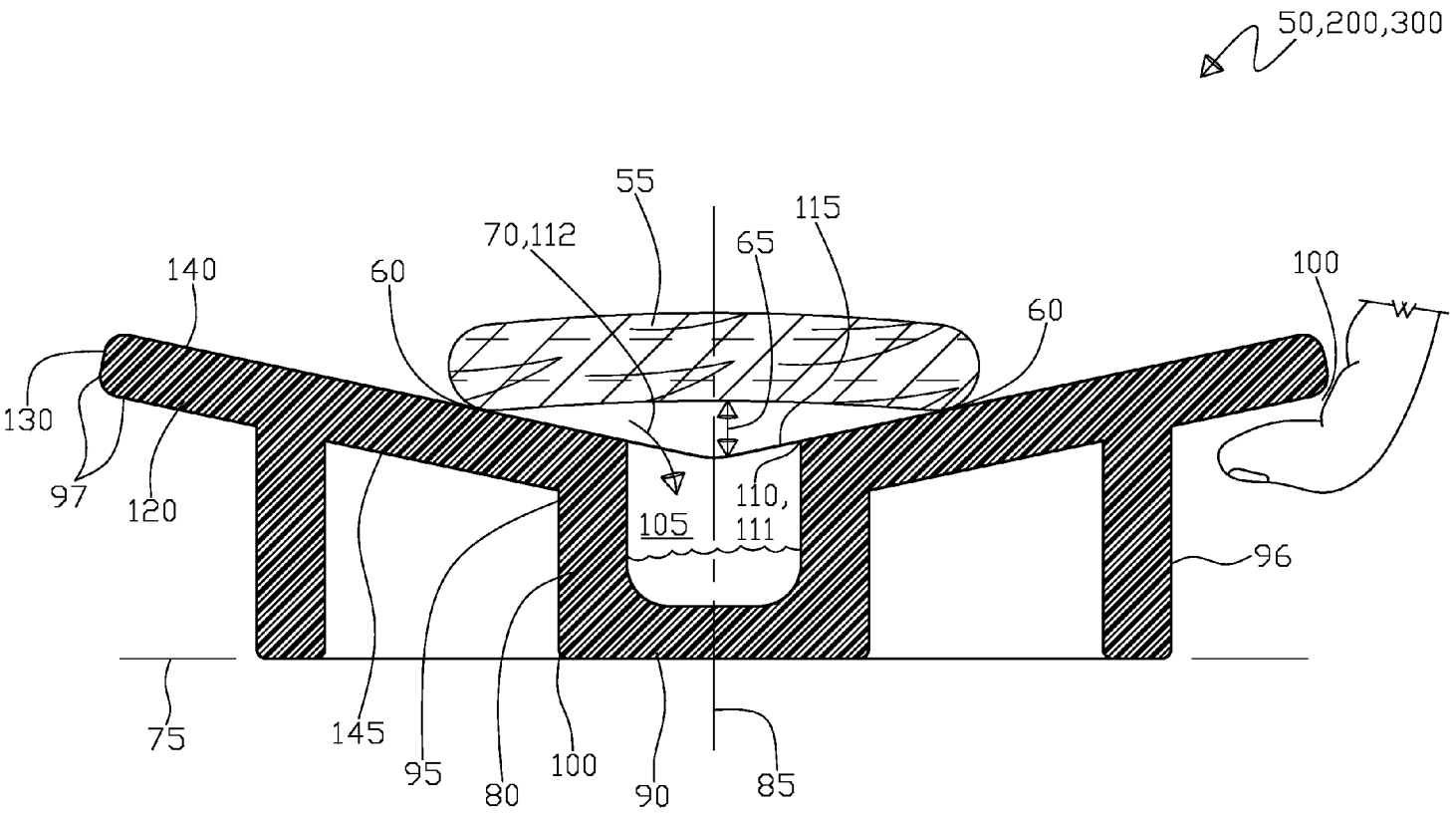
FIG. 7 shows cross section 7-7 of FIG. 5, the article support being in use with the article in a reduced size from prolonged use due to erosion positioned upon the primary surface, showing a plurality of contact points of the article on the primary surface, a separation of the article from the terminating margin, a drainage from the article into the reservoir, with the elevated perspective view of the article support that includes the surface, the base, the lengthwise axis of the base, the first end portion of the base, the second end portion of the base, the adjacent position of the first end portion to the surface, the reservoir, the terminating margin of the reservoir, the aperture of the reservoir, the substantially planar extension, the segmented primary surface, the secondary surface, and the outer perimeter of the planar extension.

Subsequently, FIG. 7 shows cross section 7-7 of FIG. 5, the article 55 support 50 being in use with the article 55 in a reduced size from prolonged use due to erosion positioned upon the primary surface 140, showing a plurality of changed inwardly positioned contact points 60 from the reduced size article 55 on the primary surface 140, while maintaining the separation 65 of the reduced size article 55 from the terminating margin 110, and the drainage 70 from the article 55 into the reservoir 105. FIG. 7 also shows the elevated perspective view of the article 55 support 50 that includes the surface 75, the base 80, the lengthwise axis 85 of the base 80, the first end portion 90 of the base 80, and the second end portion 95 of the base 80. FIG. 7 also shows the adjacent position 100 of the first end portion 90 to the surface 75, the reservoir 105, the terminating margin 110 of the reservoir 105, the aperture 115 of the reservoir 105, the substantially planar extension 120, the segmented primary surface 140, the secondary surface 145, and the outer perimeter 130 of the planar extension 120.

Figure 8:
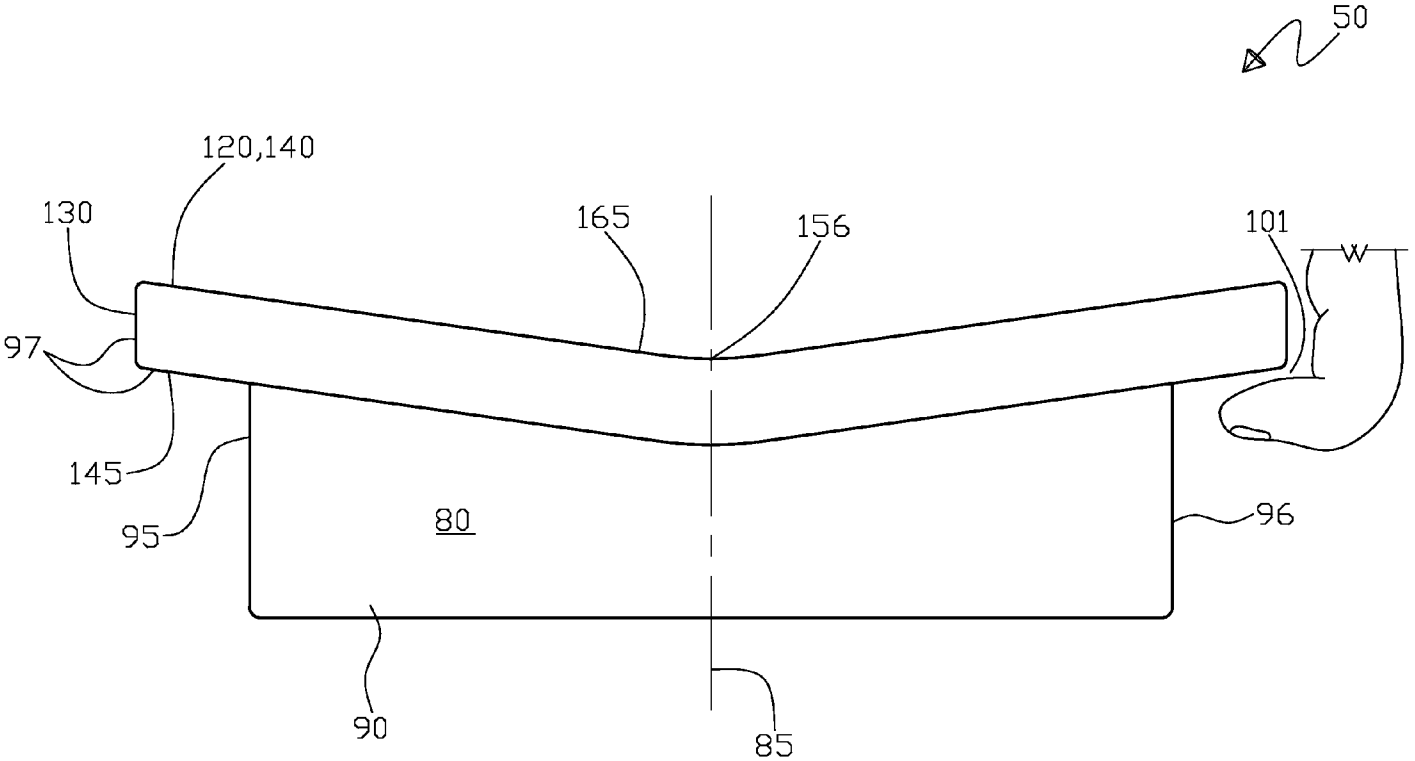
FIG. 8 is end view 8-8 from FIG. 1 showing in particular the outer perimeter, the segmented primary surface, a furrow, the base with a skirt, and a flange all in relation to the lengthwise axis, plus the manual grasping of the flange.
Figure 9:
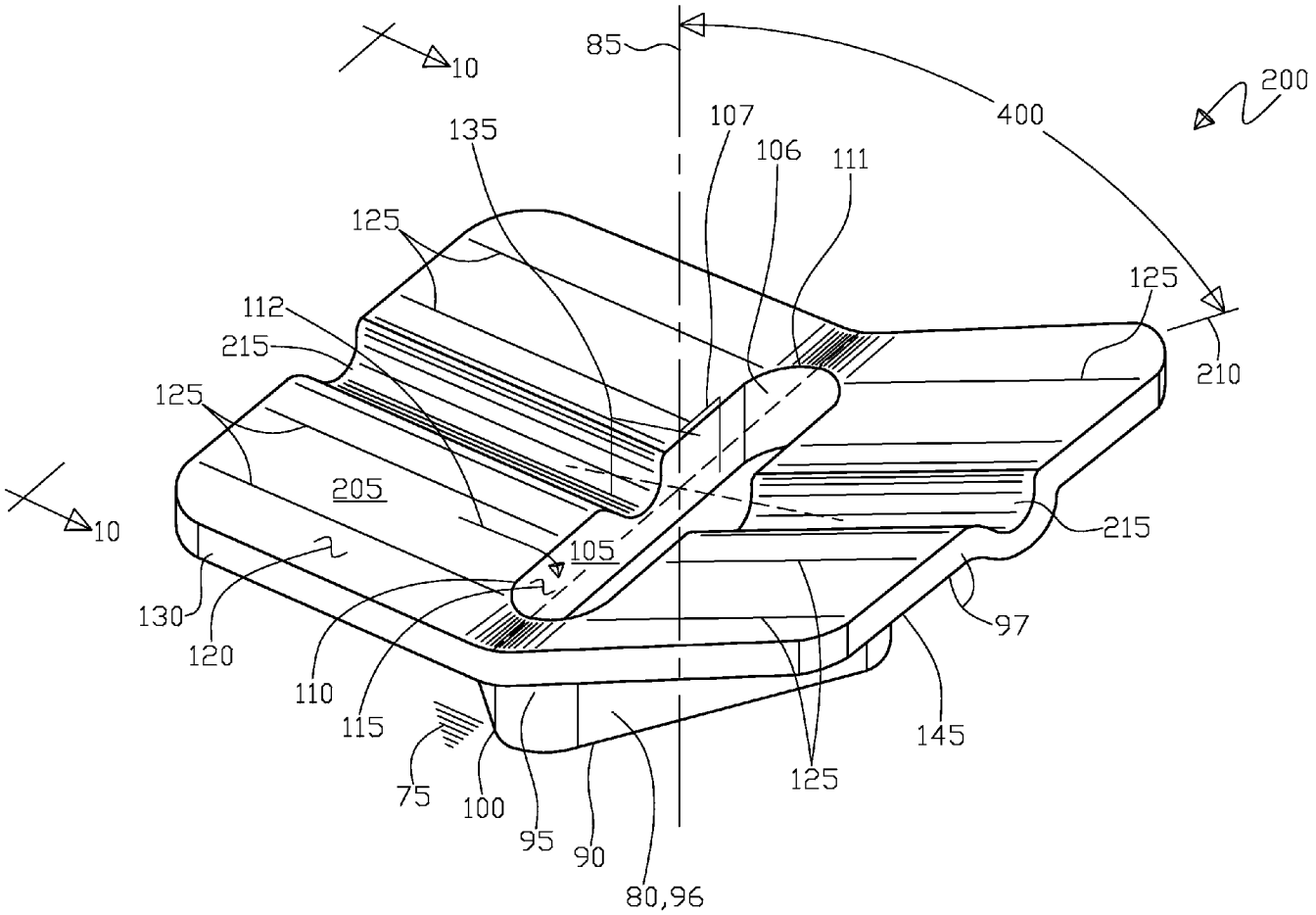
FIG. 9 shows an elevated perspective view of a first alternative embodiment of article support that includes a surface, a base, a lengthwise axis of the base, a first end portion of the base, a second end portion of the base, an adjacent position of the first end portion to a surface, a reservoir, a terminating margin of the reservoir, an aperture of the reservoir, a planar extension, a substantially perpendicular position of the planar extension to the lengthwise axis, a primary surface, a secondary surface, an angled plane of the primary surface, and an outer perimeter of the planar extension, wherein a trough is disposed in the planar primary surface.

Next, FIG. 8 is end view 8-8 from FIG. 1 showing in particular the outer perimeter 130, the segmented primary surface 140, a furrow 156, the base 80 with a skirt 96, and a flange 97, all in relation to the lengthwise axis 85, plus the manual grasping 101 of the flange 97. Continuing, FIG. 9 shows an elevated perspective view of a first alternative embodiment 200 of article 55 support that includes a surface 75, a base 80, a lengthwise axis 85 of the base, a first end portion 90 of the base 80, a second end portion 95 of the base 80, and an adjacent position 100 of the first end portion 90 to a surface 75. Further shown in FIG. 9 is a reservoir 105, a terminating margin 110 of the reservoir 105, an aperture 115 of the reservoir 105, a planar extension 120, a substantially perpendicular position 135 of the planar extension 120 to the lengthwise axis 85, a planar primary surface 205, a secondary surface 145, an angled plane 210 of the planar primary surface 205, and an outer perimeter 130 of the planar extension 120, wherein a trough 215 is disposed in the planar primary surface 205.

Figure 10:
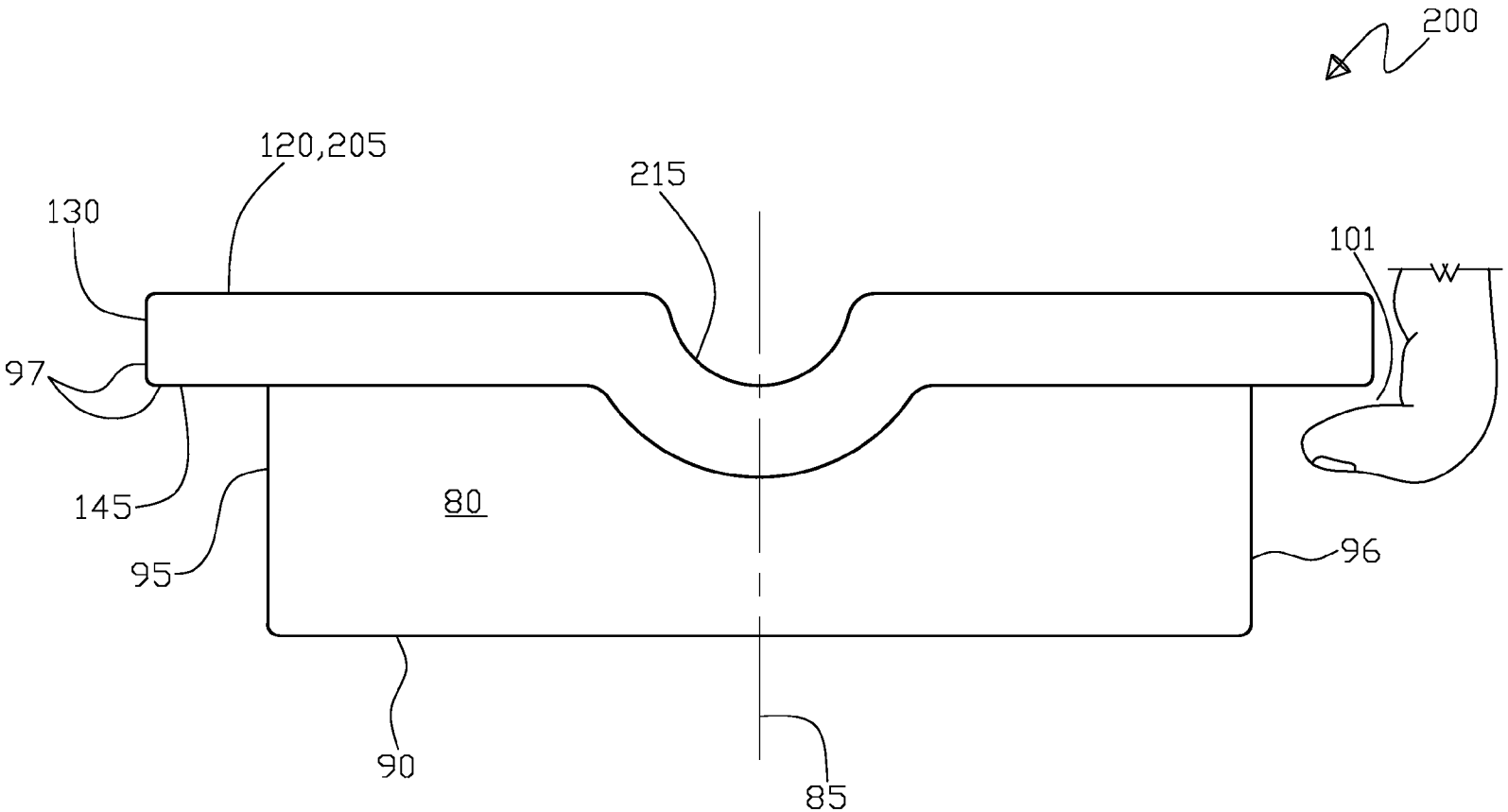
FIG. 10 is end view 10-10 from FIG. 9 showing in particular the outer perimeter, the planar primary surface with the trough disposed therein, the base with a skirt, and a flange all in relation to the lengthwise axis, plus the manual grasping of the flange.
Figure 11:
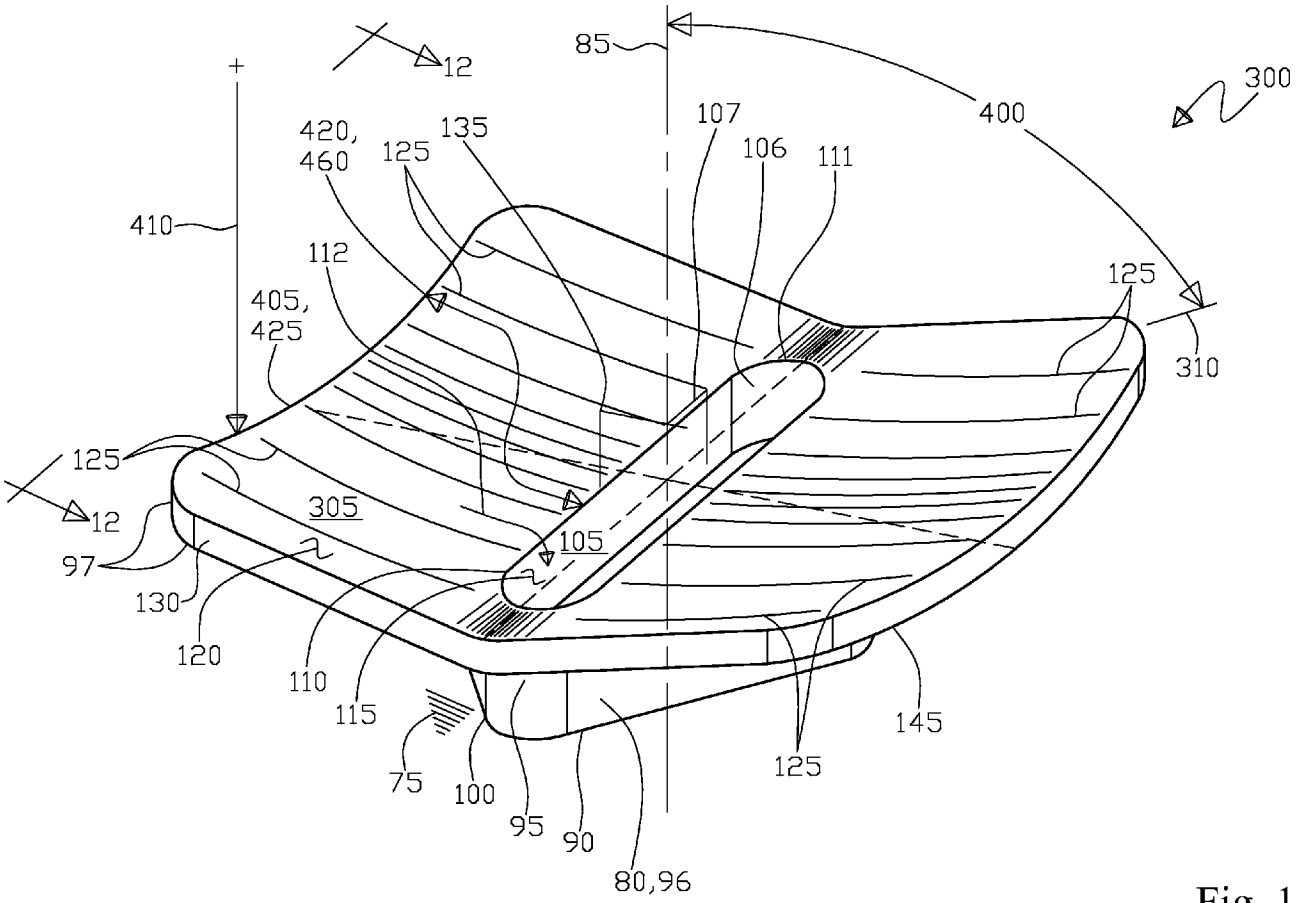
FIG. 11 shows an elevated perspective view of a second alternative embodiment of the article support that includes a surface, a base, a lengthwise axis of the base, a first end portion of the base, a second end portion of the base, an adjacent position of the first end portion to a surface, a reservoir, a terminating margin of the reservoir, an aperture of the reservoir, a planar extension, a substantially perpendicular position of the planar extension to the lengthwise axis, an arcuate primary surface, a secondary surface, an angled plane of the arcuate primary surface, and an outer perimeter of the planar extension.
Figure 12:
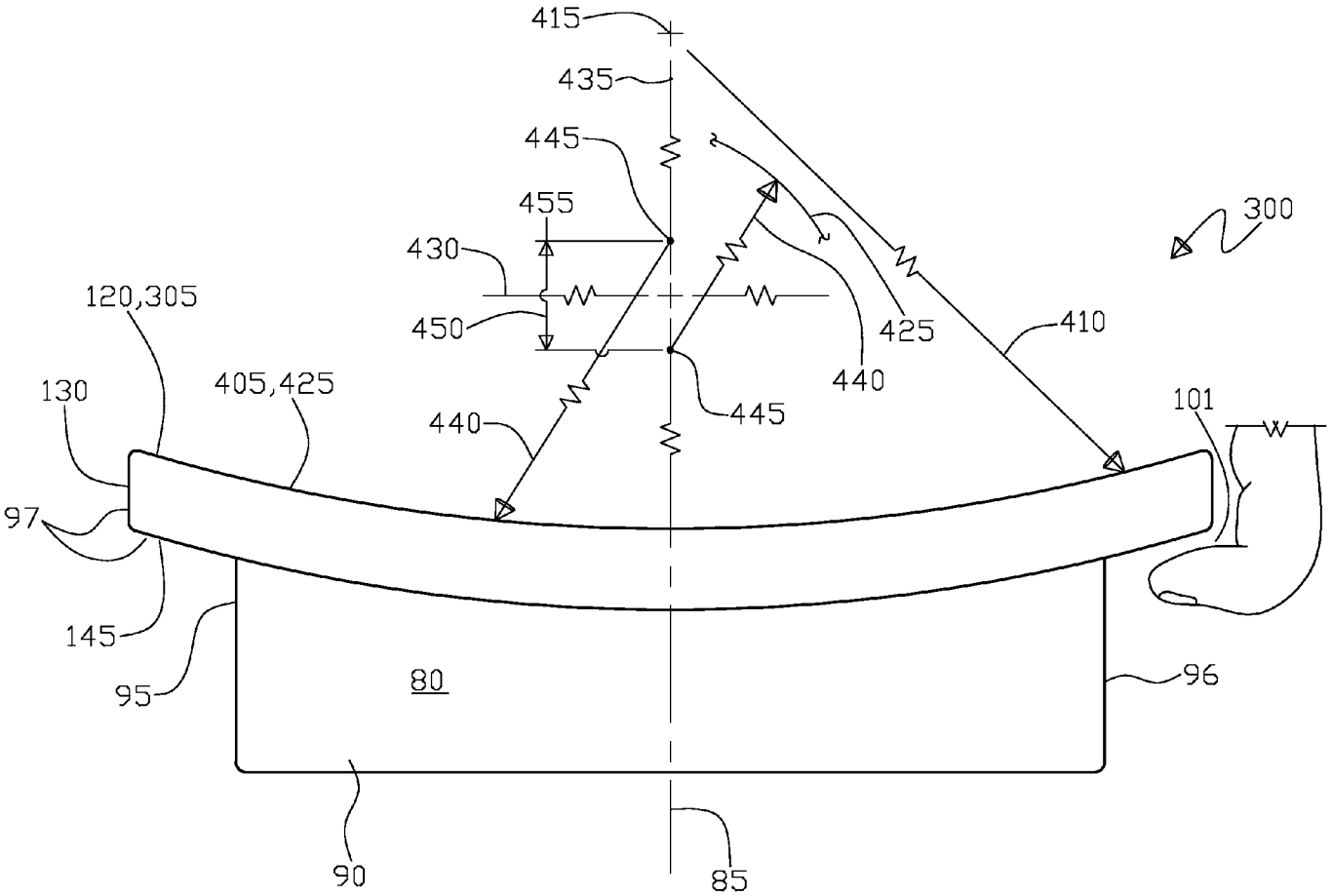
FIG. 12 is end view 12-12 from FIG. 11 showing in particular the outer perimeter, the arcuate primary surface, the base with a skirt, and a flange all in relation to the lengthwise axis, plus the manual grasping of the flange.

Further, FIG. 10 is end view 10-10 from FIG. 9 showing in particular the outer perimeter 130, the planar primary surface 205 with the trough 215 disposed therein, the base 80 with a skirt 96, and a flange 97 all in relation to the lengthwise axis 85, plus the manual grasping 101 of the flange 97. Next, FIG. 11 shows an elevated perspective view of a second alternative embodiment 300 of article 55 support that includes a surface 75, a base 80, a lengthwise axis of the base 85, a first end portion 90 of the base 80, a second end portion 95 of the base 80, an adjacent position 100 of the first end portion 90 to a surface 75. Further shown in FIG. 11 is a reservoir 105, a terminating margin 110 of the reservoir 105, an aperture 115 of the reservoir 105, a planar extension 120, a substantially perpendicular position 135 of the planar extension 120 to the lengthwise axis 85, an arcuate primary surface 305, a secondary surface 145, an angled plane 310 of the arcuate primary surface 305, and an outer perimeter 130 of the planar extension 120. Continuing, FIG. 12 is end view 12-12 from FIG. 11 showing in particular the outer perimeter 130, the arcuate primary surface 305, the base 80 with a skirt 96, and a flange 97 all in relation to the lengthwise axis 85, plus the manual grasping 101 of the flange 97.

Broadly, in referring to FIGS. 1 to 5, the present invention is for the article 55 support 50 for placement upon the surface 75, the article 55 support 50 including the base 80 having the lengthwise axis 85, the base 80 having the first end portion 90 and the opposing second end portion 95 with the lengthwise axis 85 spanning therebetween, the base first end portion 90 being positioned adjacent to the surface 75, as seen in FIGS. 1, 5, 6, and 7. Further included in the article 55 support 50 is the reservoir 105 disposed within the base 80 second end portion 95, the reservoir 105 having the terminating margin periphery 110 forming the reservoir aperture 115, see in particular FIGS. 1, 3, 5, 6, and 7. In addition, included in the article 55 support 50 is an omnidirectional 125 substantially planar extension 120 originating at the margin periphery 110 and outwardly terminating in the outer perimeter 130, the planar extension 120 is substantially perpendicular 135 to the lengthwise axis 85, see in particular FIG. 1.

Further, the planar extension 120 has the segmented primary surface 140 and the opposing secondary surface 145, wherein the secondary surface 145 faces the base first end portion 90, as best shown in FIGS. 1, 5, 6, and 7. The primary surface 140 forming the inverted equilateral square pyramid 150 wherein the apex 155 of the pyramid 150 is disposed 160 within the aperture 115 and each side face 165 of the pyramid 150 forms a proximal portion 175 of a segment 170 of the planar extension 120 primary surface 140. Then the primary surface 140 forming the angled plane 180 wherein the distal portion 185 of each segment 170 planar extension 120 primary surface 140 extends beyond the proximal portion 175 in the angled plane 180 then terminating at the outer perimeter 130, see in particular FIG. 1, plus FIG. 2 for the pyramid 150 being isolated for clarity.

Wherein operationally in use, in looking at FIGS. 5, 6, and 7 in particular, the article 55 is placed upon the primary surface 140, wherein the article 55 will have a plurality of point contacts 60 upon the primary surface 140 resulting in the article 55 being separated 65 from the terminating margin periphery 110 to facilitate unimpeded drainage 70 from the article 55 into the reservoir 105, noting that in going from FIG. 6 to FIG. 7 as the article 55 (in the form of a bar of soap) reduces in size from use the separation 65 is maintained.

Looking at FIGS. 9 and 10 in particular and FIGS. 5, 6, and 7 in general, the first alternative embodiment 200 of the article 55 support for placement upon the surface 75 is disclosed that includes the base 80 having the lengthwise axis 85, with the base 80 having the first end portion 90 and the opposing second end portion 95 with the lengthwise axis 85 spanning therebetween, wherein the base 80 first end portion 90 is adjacent to the surface 75. Also included in the first alternative embodiment 200 of the article 55 support is the reservoir 105 that is disposed within the base 80 second end portion 95, with the reservoir 105 having the terminating margin periphery 110 forming the reservoir aperture 115.

The first alternative embodiment 200 of the article 55 support further includes the omni-directional planar extension 120 originating at the margin periphery 110 and outwardly terminating in an outer perimeter 130, the planar extension 120 is substantially perpendicular 135 to the lengthwise axis 85, with the planar extension 120 having a planar primary surface 205 and the opposing secondary surface 145, wherein the secondary surface 145 faces the base 80 first end portion 90. The planar primary surface 205 forming a pair of angled planes 210, each plane 210 extending outward from opposing sides of the reservoir 105, with the pair of angled planes 210 terminating at the outer perimeter 130. Wherein operationally see FIGS. 5, 6, and 7, the article 55 is placed upon the planar primary surface 205, wherein the article 55 will have the plurality of point contacts 60 upon the planar primary surface 205 resulting in the article 55 being separated 65 from the terminating margin periphery 110 to facilitate unimpeded drainage 70 from the article 55 into the reservoir 105.

Another option for the first alternative embodiment 200 of the article 55 support for placement upon the surface 75, the optional trough 215 can be disposed in the planar primary surface 205 on each one of the pair of angled planes 210, each trough 215 extending from the outer perimeter 130 to the reservoir 105 terminating margin periphery 110, wherein operationally each of the troughs 215 acts to collect and divert drainage 70 from each of the angled planes 210 of the planar primary surface 205 to the reservoir 105.

Looking at FIGS. 11 and 12 in particular and FIGS. 5, 6, and 7 in general, the second alternative embodiment 300 of the article 55 support for placement upon the surface 75 is disclosed that includes the base 80 having the lengthwise axis 85, with the base 80 having the first end portion 90 and the opposing second end portion 95 with the lengthwise axis 85 spanning therebetween, wherein the base 80 first end portion 90 is adjacent to the surface 75. Also included in the first alternative embodiment 200 of the article 55 support is the reservoir 105 disposed within the base 80 second end portion 95, with the reservoir 105 having the terminating margin periphery 110 forming the reservoir aperture 115.

The second alternative embodiment 300 of the article 55 support further includes the omni-directional planar extension 120 originating at the margin periphery 110 and outwardly terminating in the outer perimeter 130, the planar extension 120 is substantially perpendicular 135 to the lengthwise axis 85, the planar extension 120 having the arcuate primary surface 305 and an opposing secondary surface 145, wherein the secondary surface 145 faces the base 80 first end portion 90. The arcuate primary surface 305 forming the pair of angled planes 310, wherein each angled plane 310 forms an acute angle 400 with the lengthwise axis 85, wherein each angled plane 310 extends outward from opposing sides of the reservoir 105, with the pair of angled planes 310 terminating at the outer perimeter 130. Wherein operationally see FIGS. 5, 6, and 7, the article 55 is placed upon the arcuate primary surface 305, wherein the article 55 will have the plurality of point contacts 60 upon the arcuate primary surface 305 resulting in the article 55 being separated 65 from the terminating margin periphery 110 to facilitate unimpeded drainage 70 from the article 55 into said reservoir 105. Although FIGS. 5, 6, and 7, principally show the article support 50, FIGS. 5, 6, and 7 apply as well to the first 200 and second 300 alternative embodiments of the article 55 support in so far as the article 55 placement on the planar extension 120, with the reservoir 105, and the base 80.

Optionally, for the second alternative embodiment 300 of the article 55 support for placement upon the surface 75, the arcuate primary surface 305 can be formed from an arc 405 emanating from a constant radius 410 at a fixed origin point 415, wherein the arc 405 is juxtapose 420 to the elongated open channel shape 106 of the reservoir 105, wherein operationally the arc surface 405 helps to direct the drainage 70, see in particular FIGS. 11 and 12.

Also, optionally for the second alternative embodiment 300 of the article 55 support for placement upon a surface 75, wherein the arcuate primary surface 305 can be formed from an ellipse 425 via a trammel method, with the ellipse 425 having a major axis 430 and a minor axis 435, with the ellipse 425 formed from a fixed radius 440 that equals in length one-half (½) of the major axis 430, wherein the fixed radius 440 pivot point 445 travels along 450 the minor axis 435 moving a symmetrical distance 455 about the major axis 430 therethrough a single revolution of the fixed radius 440 around the ellipse 425, wherein the ellipse 425 is juxtapose 460 to the elongated open channel shape 106 of the reservoir 105, wherein operationally the ellipse 425 surface helps to direct the drainage 70, see in particular FIGS. 11 and 12.

Optionally for either the article support 50, the first alternative embodiment 200 of the article 55 support, or the second alternative embodiment 300 of the article 55 support, the reservoir 105 can have an elongated open channel shape 106 that is substantially symmetric about the lengthwise axis 85, wherein the elongated shape 106 extends perpendicular 107 to the lengthwise axis 85, operationally this is to increase a volumetric capacity of the reservoir 105 with minimal loss of the planar extension primary surface 140, 205, 305 thus giving the article 55 more support area on the planar extension primary surface 140, 205, 305, as best shown in FIGS. 1, 5, 6, 7, 9 and 11.

Further, optionally for either the article support 50, the first alternative embodiment 200 of the article 55 support, or the second alternative embodiment 300 of the article 55 support, the reservoir 105 terminating margin periphery 110 can structurally form a transitional radius 111 from the planar extension primary surface 140, 205, 305 to the reservoir channel 106, wherein the transitional radius 111 follows the elongated open channel shape 106 in a peripheral manner, again as best shown in FIGS. 1, 5, 6, 7, 9 and 11.

Yet further, optionally for either the article support 50, the first alternative embodiment 200 of the article 55 support, or the second alternative embodiment 300 of the article 55 support wherein the base 80 and the planar extension 120 are structurally integral to one another facilitating a continuously smooth drainage flow path 112 from the primary surface 140, 205, 305 to the reservoir 105 terminating margin 110 to the open channel shape 105, again as best shown in FIGS. 1, 5, 6, 7, 9, and 11.

Again further, optionally for either the article support 50, the first alternative embodiment 200 of the article 55 support, or the second alternative embodiment 300 of the article 55 support, wherein the base 80 can have an outer terminating skirt 96, wherein the skirt 96 is positioned about the lengthwise axis 85, further the skirt 96 is positioned inward from the planar extension 120 outer perimeter 130, see FIGS. 1, 4, 5, 6, 7, 8, 9, 10, 11, and 12. Wherein operationally, the skirt 96 being positioned inward from the planar extension 120 outer perimeter 130 forms a flange 97 on the planar extension 120 secondary surface 145 and the planar extension 120 outer perimeter 130 that is utilized for manual grasping 101 of the article support 50, 200, 300 to remove the article support 50, 200, 300 from the surface 75, see FIGS. 6, 7, 8, 10, and 12.

Again further, optionally for either the article support 50, the first alternative embodiment 200 of the article 55 support, or the second alternative embodiment 300 of the article 55 support, wherein the proximal portion angled plane 180, or planar primary surface angled plane 210, arcuate primary surface angled plane 310 forms an acute angle 400 with the lengthwise axis 85 to further facilitate the drainage 70 flow path, see FIGS. 1, 9, and 11.

Another option for the article support 50 for placement upon a surface 75, wherein a furrow 156 can be formed as between each pyramid side face 165 on the primary surface 140, wherein a plurality of the furrows 156 form dividing lines as between a plurality of segments 170 on the primary surface 140 forming the segmented primary surface 140, wherein operationally each of the furrows 156 acts to collect and divert drainage 70 to the reservoir 105.

Again further, optionally for either the article support 50, the first alternative embodiment 200 of the article 55 support, or the second alternative embodiment 300 of the article 55 support, wherein the acute angle 400 is preferably about seventy-five (75) degrees.

CONCLUSION

Accordingly, the present invention of an article support including the first and second alternative embodiments have been described with some degree of particularity directed to all the embodiments of the present invention. It should be appreciated, though; that the present invention is defined by the following claims construed in light of the prior art so modifications or changes may be made to the exemplary embodiments of the present invention without departing from the inventive concepts contained therein.

The invention claimed is:

1. An article support for placement upon a surface, said support comprising:

(a) a base having a lengthwise axis, said base having a first end portion and an opposing second end portion with said lengthwise axis spanning therebetween, said base first end portion is adjacent to the surface, wherein said base has a continuous outer terminating skirt surface that is adjacent to the surface, wherein said skirt is positioned about said lengthwise axis;

(b) a reservoir disposed within said base second end portion, said reservoir disposed within said continuous outer terminating skirt surface, said reservoir having a terminating margin periphery forming a reservoir aperture, wherein said reservoir has an elongated open channel shape that is substantially symmetric about said lengthwise axis, wherein said elongated shape extends perpendicular to said lengthwise axis; and (c) an omni-directional substantially planar extension originating at said margin periphery and outwardly terminating in an outer perimeter, said planar extension is substantially perpendicular to said lengthwise axis, said planar extension having a continuous segmented primary surface and an opposing secondary surface wherein said secondary surface faces said base first end portion, said continuous primary surface forming an inverted equilateral square pyramid wherein an apex of said pyramid is disposed within said aperture and each side face of said pyramid forms a proximal portion of a segment of said planar extension primary surface forming an angled plane wherein a distal portion of each said segment planar extension primary surface extends beyond said proximal portion in said angled plane terminating at said outer perimeter, wherein a continuous furrow is formed as between each said pyramid side face on said primary surface, wherein a plurality of said furrows form dividing lines as between a plurality of segments on said primary surface forming said segmented primary surface, wherein operationally each of said furrows acts to collect and divert drainage to said reservoir, wherein said reservoir terminating margin periphery structurally forms a transitional radius from said planar extension primary surface to said reservoir channel, wherein said transitional radius follows said elongated open channel shape in a peripheral manner, wherein said base and said planar extension are structurally integral to one another facilitating a continuously smooth drainage flow path from said primary surface to said reservoir terminating margin to said open channel shape, wherein said proximal portion angled plane forms an acute angle with said lengthwise axis to further facilitate said drainage flow path, wherein operationally the article is placed upon said primary surface, wherein the article will have a plurality of point contacts upon said primary surface resulting in the article being separated from said terminating margin periphery to facilitate unimpeded drainage from the article into said reservoir, further said continuous outer terminating skirt is positioned inward from said planar extension outer perimeter, wherein operationally said skirt being positioned inward from said planar extension outer perimeter forms a continuous flange on said planar extension secondary surface and said planar extension outer perimeter that is utilized for manual grasping of said article support to remove said article support from the surface.

2. An article support for placement upon a surface according to claim 1 wherein said acute angle is about seventy-five (75) degrees.

3. A first alternative embodiment article support for placement upon a surface, said support comprising:

(a) a base having a lengthwise axis, said base having a first end portion and an opposing second end portion with said lengthwise axis spanning therebetween, said base first end portion is adjacent to the surface, wherein said base has a continuous outer terminating skirt surface that is adjacent to the surface, wherein said skirt is positioned about said lengthwise axis;

(b) a reservoir disposed within said base second end portion, said reservoir disposed within said continuous outer terminating skirt surface, said reservoir having a terminating margin periphery forming a reservoir aperture, wherein said reservoir has an elongated open channel shape that is substantially symmetric about said lengthwise axis, wherein said elongated shape extends perpendicular to said lengthwise axis; and (c) an omni-directional planar extension originating at said margin periphery and outwardly terminating in an outer perimeter, said planar extension is substantially perpendicular to said lengthwise axis, said planar extension having a continuous planar primary surface and an opposing secondary surface wherein said secondary surface faces said base first end portion, said continuous primary surface forming a pair of angled planes, each said plane extending outward from opposing sides of said reservoir, with said pair of angled planes terminating at said outer perimeter, wherein a continuous trough is disposed in said planar primary surface on each one of said pair of angled planes, each said continuous trough extending from said outer perimeter to said reservoir terminating margin periphery, wherein operationally each of said continuous troughs acts to collect and divert drainage from each of said angled planes of said planar primary surface to said reservoir, wherein said reservoir terminating margin periphery structurally forms a transitional radius from said planar extension primary surface to said reservoir channel, wherein said transitional radius follows said elongated open channel shape, wherein said base and said planar extension are structurally integral to one another facilitating a continuously smooth drainage flow path from said primary surface to said reservoir terminating margin to said open channel shape, wherein each said angled plane forms an acute angle with said lengthwise axis to further facilitate said drainage flow path, wherein operationally the article is placed upon said primary surface, wherein the article will have a plurality of point contacts upon said primary surface resulting in the article being separated from said terminating margin periphery to facilitate unimpeded drainage from the article into said reservoir, further said continuous outer terminating skirt is positioned inward from said planar extension outer perimeter, wherein operationally said skirt being positioned inward from said planar extension outer perimeter forms a continuous flange on said planar extension secondary surface and said planar extension outer perimeter that is utilized for manual grasping of said article support to remove said article support from the surface.

4. A first alternative embodiment article support for placement upon a surface according to claim 3 wherein said acute angle is about seventy-five (75) degrees.

* * * * *